United States Patent [19]

Hartshorn

[11] Patent Number: 4,705,068

[45] Date of Patent: Nov. 10, 1987

[54] PORTED-PLATE, FLUID CONTROL VALVE

[75] Inventor: Kevin Hartshorn, Plainsboro, N.J.

[73] Assignee: Ingersoll-Rand Company, Woodcliff Lake, N.J.

[21] Appl. No.: 923,414

[22] Filed: Oct. 27, 1986

[51] Int. Cl.[4] ..... F16K 15/08

[52] U.S. Cl. ..... 137/512.1; 137/516.13; 137/516.21; 137/516.23

[58] Field of Search ..... 137/512.1, 516.11, 516.13, 137/516.15, 516.17, 516.19, 516.21, 516.23

[56] References Cited

U.S. PATENT DOCUMENTS

| | | | |
|---|---|---|---|
| 1,343,534 | 6/1920 | Voss | 137/512.1 |
| 1,487,023 | 3/1924 | Riesner | 137/516.23 |
| 2,870,783 | 1/1959 | Kehler | 137/516.13 |
| 3,273,591 | 9/1966 | Stewart | 137/512.1 |
| 3,358,710 | 12/1967 | Page | 137/512.1 |
| 3,703,912 | 11/1972 | Bauer et al. | 137/516.13 X |

FOREIGN PATENT DOCUMENTS

| | | | |
|---|---|---|---|
| 1236503 | 6/1960 | France | 137/516.19 |
| 1002865 | 9/1965 | United Kingdom | 137/516.21 |

*Primary Examiner*—Alan Cohan
*Assistant Examiner*—John A. Rivell
*Attorney, Agent, or Firm*—B. J. Murphy

[57] ABSTRACT

The valve comprises a configuration in which the flow-through paths are more uniformly and smoothly arranged, albeit incorporating additional paths vis-a-vis prior art valves of like overall dimensions. The additional paths are accommodated through reliefs formed in the base of a central guide ring, and scallop cut-outs in the inner-diameter surfaces of buffer plates. Essentially, the flow-through paths are positioned more radially-outward, to facilitate the additional paths near the center, and to reduce the expanse of the otherwise excessive, radially outermost annulus obtaining between the enclosing wall of the valve and the outer, peripheral surfaces of the valving and buffer plates.

7 Claims, 9 Drawing Figures

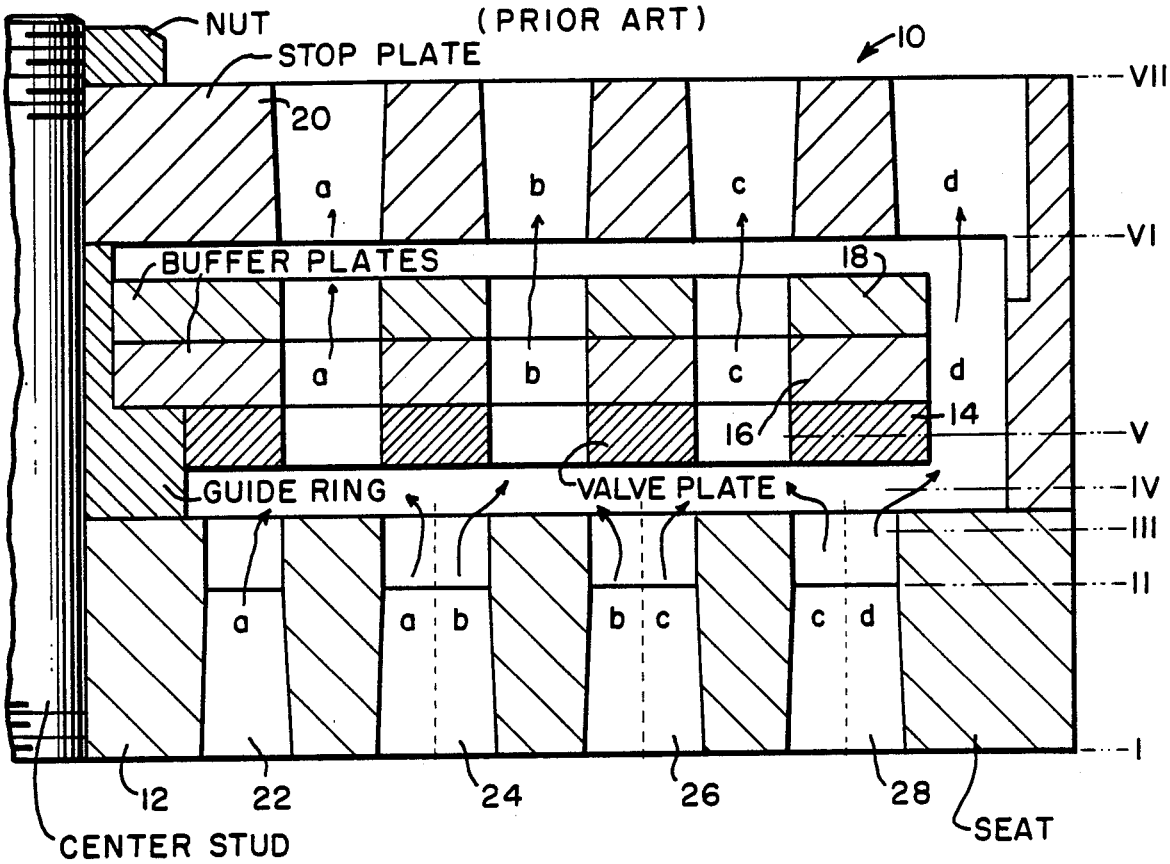
FIG. 1
FIG. 2
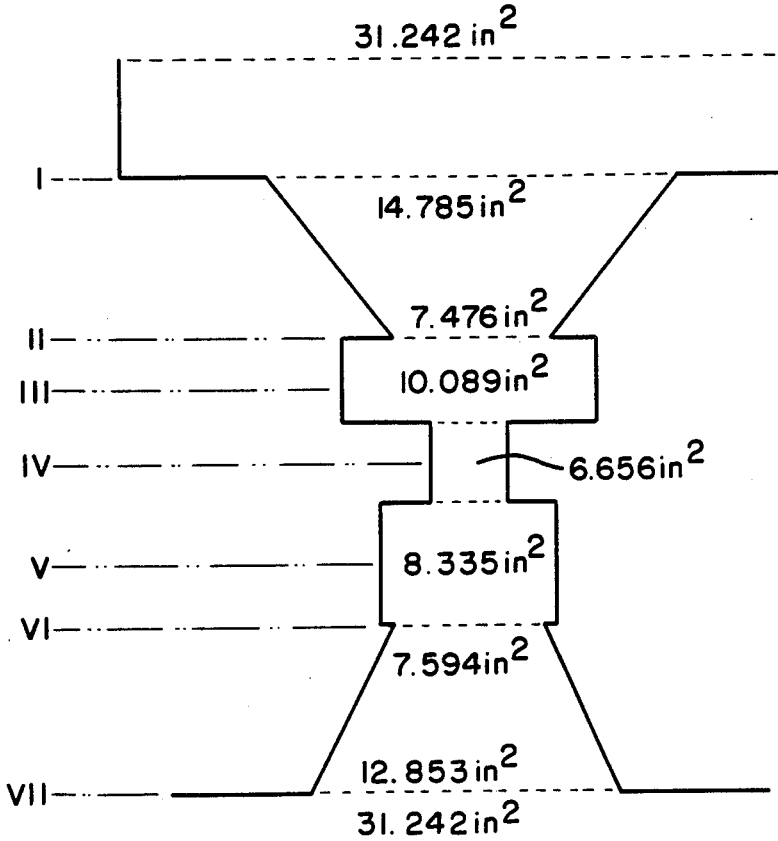

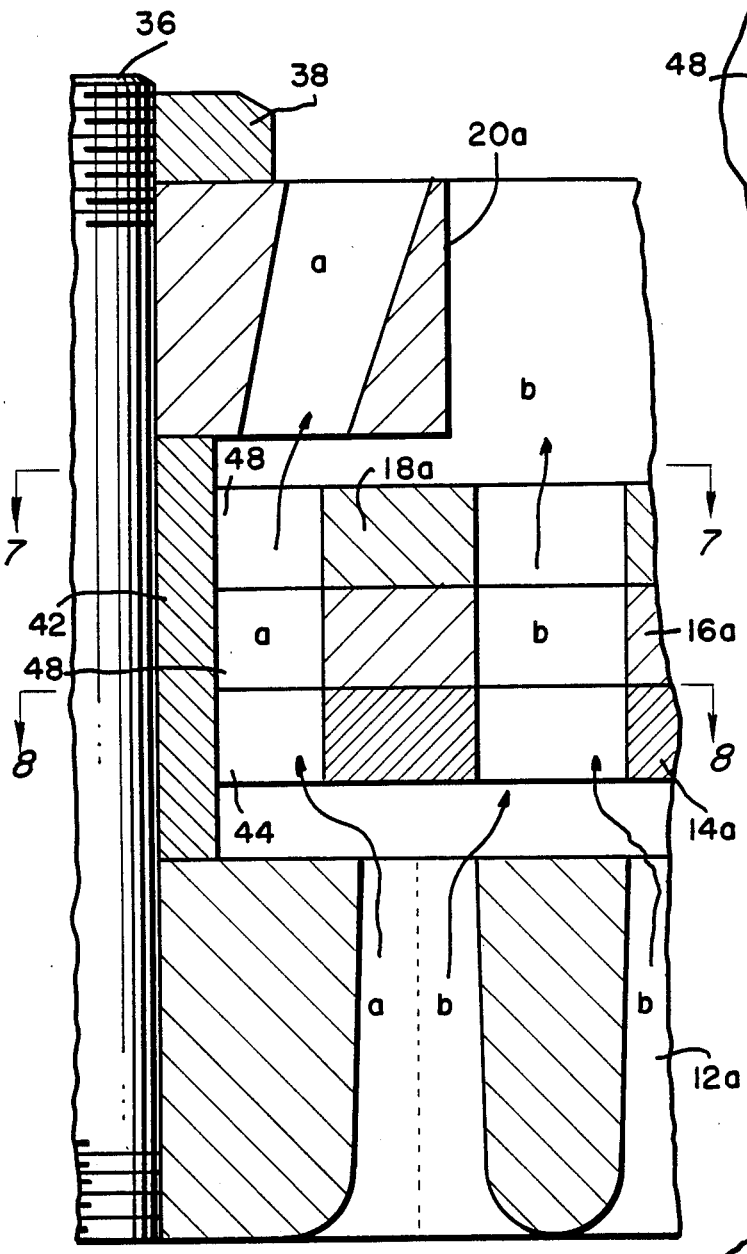
FIG. 6
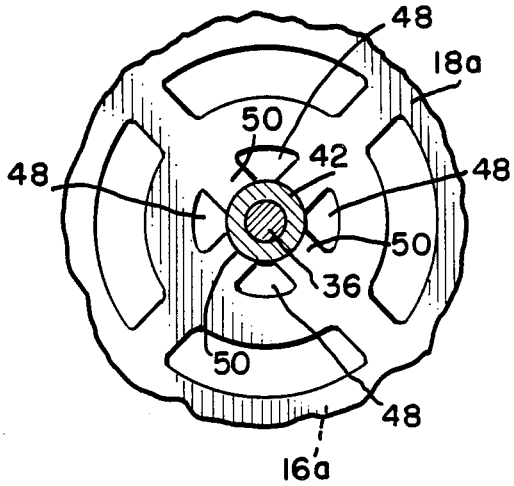
FIG. 7
FIG. 8
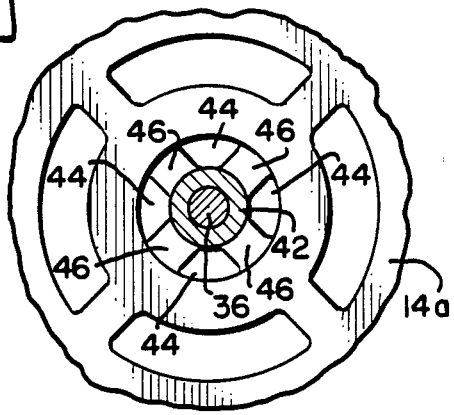

PORTED-PLATE, FLUID CONTROL VALVE

This invention pertains to fluid-control valves, and in particular to ported-plate, fluid-control valves such as are used in reciprocating compressors.

Typically, a plurality of these valves are employed in each compressor cylinder. That is, each cylinder end may have a number of inlet and discharge valves. The size of a particular valve is very much dependent upon the space available in the cylinder. The amount of space available essentially dictates the port area available to the valve designer. Hopefully, the designer will have sufficient space to allow the application of a valve configuration which has the characteristics of good effective flow area without having to utilize excessively high lifts which could detract from the life of the valve element.

The designer is faced with a number of decisions which relate to compressor efficiency. Valve porting, valve element geometry, springing and valve lift are a few of the first considerations given to a valve design. Each can have an impact on the valve losses arising from inefficiencies of the flow transfer process while the valve element is in the open position. The valve losses directly impact the performance of the compressor cylinder in which they are installed. Since the compressor manufacturer may pay penalties in lost orders due to differences in efficiency of a few points, it is becoming increasingly important to reduce the overall loss and particularly the valve loss as much as possible.

Once the cylinder specifications have been established, the valve designer may begin making selections. Such designer begins by identifying the available port area in which it is possible to design any one of a number of different valve seat geometries. Once the seat geometry is established, the remainder of the valve assembly is analyzed and detailed.

It is an object of this disclosure to identify particular aspects of the design effort which can be addressed to achieve improved, effective flow through the valve.

It is particularly an object of this invention to set forth a ported-plate, fluid-control valve, comprising a ported valve seat; a stop plate; means coupling said seat and plate together, in parallel, and spaced apart; and a plate-type valving element interpositioned between said seat and plate; wherein said seat, plate and element comprise (a) first means defining a first fluid inlet zone, a second fluid outlet zone, and a plurality of discrete, fluid-conducting zones intermediate said first and second zones, and (b) second means for effecting a substantially smooth flow of fluid through said zones.

Further objects of this invention, as well as the novel features thereof, will become more apparent by reference to the following description taken in conjunction with the accompanying figures, in which:

FIG. 1 is a cross-sectional view through a half of a prior art, ported-plate, fluid control valve;

FIG. 2 is a depiction of the areas obtaining in several zones of the FIG. 1 valve;

FIG. 6 is a fragmentary, cross-sectional view being enlarged over the scale of FIGS. 4 and 5, of the novel valve of FIGS. 4 and 5, the same showing the center stud, nut, inner portions of the seat, valve plate and buffer plates, a whole half of the guide ring, and a whole half of the stop plate;

Figure 3:
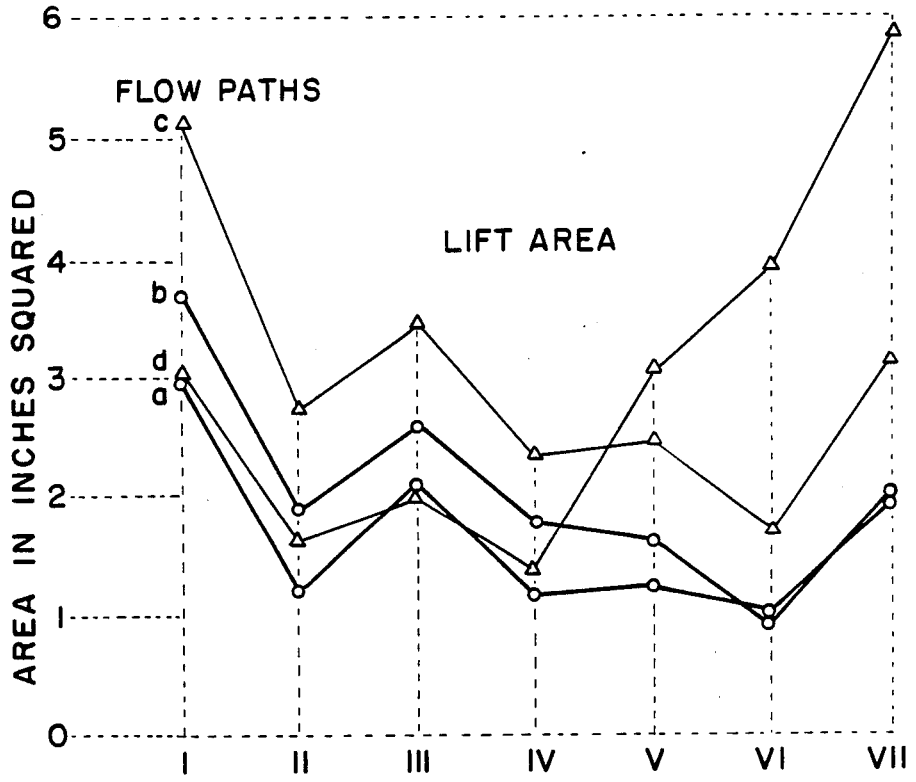
FIG. 3 is a plot of the areas of FIG. 2 in a different graphic presentation, the same distinguishing the areas obtaining in the discrete flow paths at the several zones.
Figure 9:
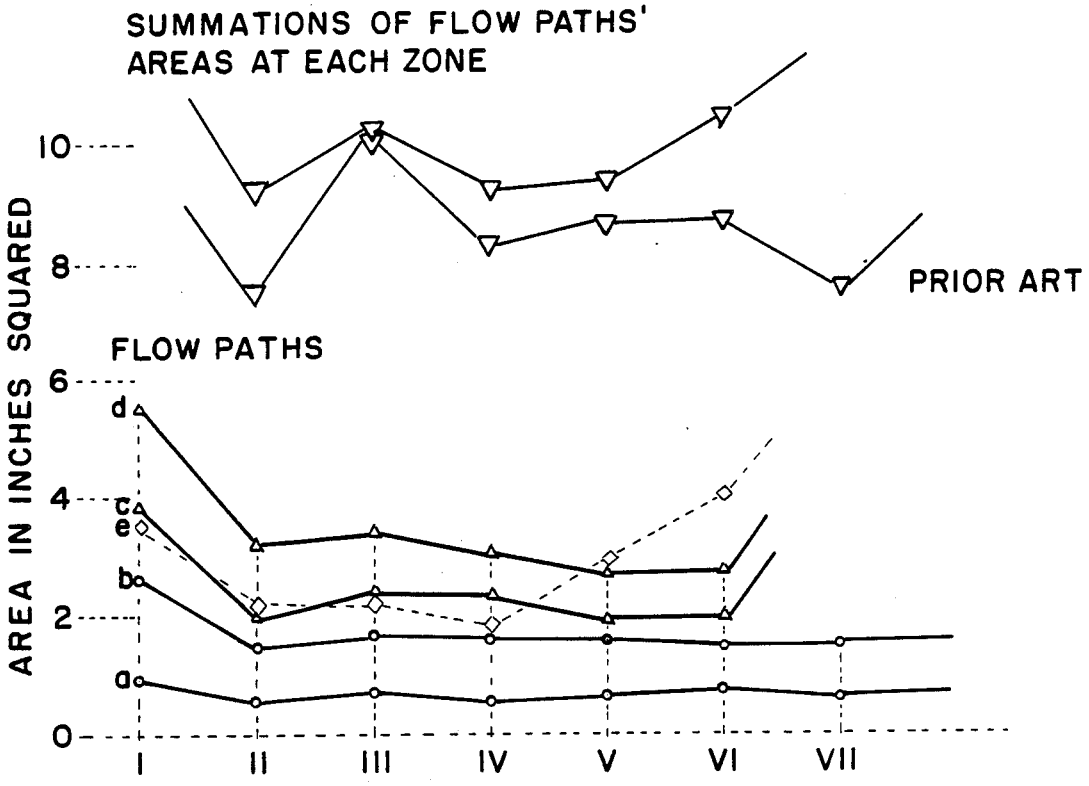

FIGS. 7 and 8 are cross-sectional views taken along sections 7—7 and 8—8 of FIG. 6; and FIG. 9 comprises a plot of areas, similar to that of FIG. 3, for a valve defined according to the invention in which, however, five flow paths are formed, and includes as well plots of sums of the areas for a like, five-flow path prior art valve vis-a-vis the novel five-flow path valve of the instant invention.

A cross-section of a half of a prior art, ported-plate valve assembly 10 is shown in FIG. 1. As seen, the seat 12, valve plate 14, buffer plates 16 and 18 and stop plate 20 are aligned and located in a particular way to describe a series of flow paths "a", "b", "c", and "d". The ports 22, 24, 26 and 28 in the seat, and the corresponding ports in the aforesaid plates, in each case, actually span an arc and are often referred to as "kidney-shaped". These ports define the four flow paths "a", "b", "c", and "d" through the assembly. In three cases, the flow ports in the seat 12, i.e., ports 24, 26 and 28, are split by dotted lines. This is a basic assumption in addressing the flow transfer process through zones in the assembly 10. To discuss the actual transfer process, each important zone has been identified by a Roman numeral. The specific zones identified in FIG. 1 are:

I—Entry to Seat
II—Entry to the Sealing Annulus
III—Sealing Annulus
IV—Lift Area
V—Projected Valve Plate Opening
VI—Entry to Stop Plate
VII—Exit from Stop Plate By systematically computing the geometric area of each of the identified zones in the valve assembly 10, it is possible to represent the zone-to-zone transitions schematically as shown in FIG. 2. As is depicted by the schematic, the flow paths "a", "b", "c", and "d" through the assembly 10 are complicated by a series of abrupt oontractions and expansions as the gas flow transfers from one of the aforesaid zones of the assembly to the next. FIG. 2 represents the total area at each of the identified zones of the valve assembly 10. That is, it presents the summation of all port contributions at the particular zones. If the individual flow paths "a", "b", "c", and "d" are traced through the assembly 10, the area contributions of each zone can be plotted as shown in FIG. 3. Note that even after the flow has entered the valve seat 12, abrupt and rapid transitions are presented. It is of particular interest to note the huge, outer annular area available to port 28 via flow path "d". Approximately forty percent of the total flow area of the valve assembly 10 is located in this outer annulus.

The losses incurred by the gas flowing through the valve assembly 10 are attributable to two causes: frictional losses due to contact with the walls of the component parts, and dissipation due to the translational effects seen when the flow passes from one zone to another. The primary loss mechanism associated with the second source is that of energy dissipation due to the mixing which takes place in the sites of separation caused by the abrupt contractions and expansions. A desired flow transition scheme is that of gradual change in area with smooth corners, and with a minimum of rapid cross-sectional change.

Based upon area computations for the prior art valve assembly 10, it was undertaken to redesign the basic configuration with loss mechanisms in mind considering the transitions from one zone section to the next. Illustrations depicting the novel modifications made, to define the inventive, improved valve 10*a*, are shown in FIGS. 4–8.

Following is a description of the changes made to basic valve geometry in order to achieve as smooth a fluid-flow transition as possible, in accordance with the invention. Index numbers or letters in FIGS. 4–8 which are the same as, or similar to, index numbers in FIGS. 1–3 denote same or similar components, or areas, or zones.

The first step was to address the way in which the seat porting is arranged, to avoid the large annular area and mismatch seen in the prior art design (FIG. 1). Pursuant to my invention, the ports 22, 24, 26 and 28 have been moved outward thus reducing the annular gap, albeit providing for a complementary or better area match with the available area in seat ports 28.

The sudden contraction in area seen at the entrance to the valve seat 12, in zone I, is difficult to deal with. Generally, a large volume is present just upstream of the seat making it difficult, due to space restrictions, to make any significant change in the zone transition. The best approach was that of adding a generous radius to the lead-in section of each port.

Figure 4:
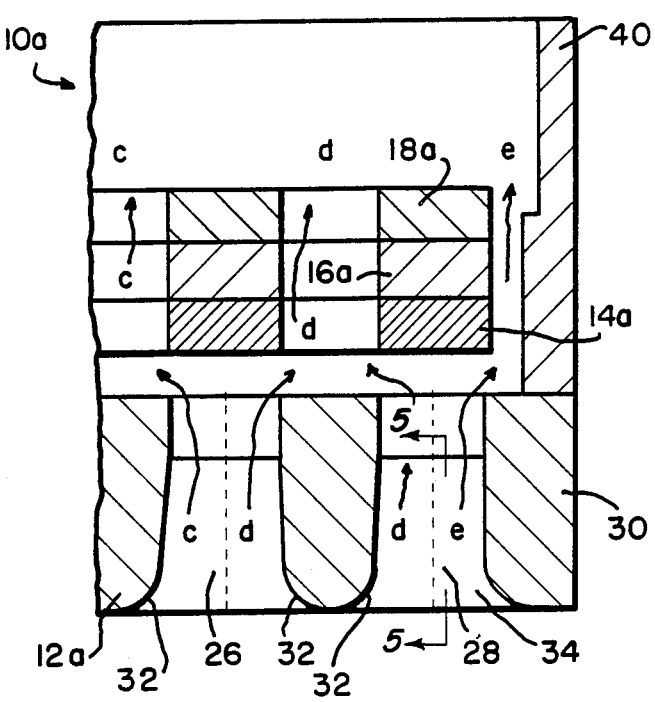
FIG. 4 is a cross-sectional view through an outer portion of an embodiment of the invention.

With special reference to FIG. 4, and the outer perimeter 30 of the seat 12*a*, the disposition of the ports can be appreciated. Port 28, of course, is one of a plurality thereof at a given radius; so too with ports 26 and 24. The latter two, also, have companions about the seat 12*a* at their radii. The outermost ports, of which port 28 is representative, are substantially as proximate to perimeter 30 as to inboard seat ports which are closest thereto; port 26 is representative of such closest inboard seat ports.

As for the noted radiusing of the port entries, it can be noted that the radiuses 32, which line the apertures of the ports 28, 26, etc., are conjoined. A radius 32, inboard of port 28, is contiguous with a radius 32 outboard of port 26, for example.

The next abrupt change is that at zone II leading into the sealing annulus. According to my invention, this is handled by designing a reverse taper in the ligaments 34 at the ends of the kidney-shaped ports in the seat 12*a*.

Figure 5:
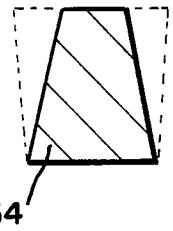
FIG. 5 is a cross-section view taken along section 5—5 of FIG. 4.

In prior art valves of this type, the radial, port-separating ligaments have a cross-sectional configuration as shown in FIG. 5 in dashed-line outline. To diminish the abrupt change in geometry at the entry to the sealing annulus, i.e., at zone II, I define the ligaments with the aforesaid reverse taper. Ligament 34, of FIG. 5, is representative.

An efficient use of the available valve area, in the horizontal projection, eliminates much of the large annulus at the periphery of the valve plate 12*a*. However, there is more. By moving the ports toward the valve perimeter 30 there is a natural gain in flow area due to a diameter effect. Consequently, the lift area also increases since each element is at a larger radius. Also, this novel teaching accommodates for another flow path; of this, more is explained in the ensuing text.

The mismatch at the entrance to the stop plate, i.e., at zone VI, is addressed by simply considerably opening the stop plate 20*a*. As can be seen in FIG. 6, the stop plate 20*a* is simply a short-radius, ported disc mounted on the center stud 36 and secured by a nut 38. It does not extend to the wall 40 of the valve 10*a*.

Having moved the ports toward the valve perimeter 30, and by introducing refinements to the guide ring 42 and the buffer plates 16*a* and 18*a*, I provide a fifth flow path.

The guide ring 42 is centralized on the guide or center stud 36, but its lowermost portion, its base, which pilots the valve plate 14*a*, has a plurality of scalloped reliefs 44 therein, leaving radial arms 46 for guiding the plate 14*a* therealong. Similarly, the inner portions of the buffer plates 16*a* and 18*a* have scalloped reliefs or cutouts 48 formed therein, leaving inwardly directed limbs 50 for guidingly engaging the ring 42. Also, stop plate 20*a*, as noted, is noted.

Reliefs 48 and 44 are in common alignment or registry with each other, and with the ports in stop plate 20*a*, to provide a new, innermost flow path "a". (Alignment pins, not shown, maintain the ring 42 and plates 14*a*, 16*a* and 18*a* in aligned registry.) Consequently, with reference to FIG. 1, the paths which are designated "a", "b", "c", and "d" are all upscaled in the new valve. That is, in the inventive valve 10*a*, the outermost flow path, now is a fifth path "e", path "d", now, is the next, inner one, etc., and within a valve 10*a* of a same given overall diameter as valve 10 (in the prior art), I have provided five flow paths along a radial plane where, in the prior art valve 10, only four were provided.

Combined, the net effect of my new valve is as plotted, in FIG. 7, for the five-flow path ("a", "b", "c", "d", and "e") embodiment. Note that, in comparison to a like, prior art valve design, the transition in summed area, from one zone to the next, is much more smooth or uniform, and that there is a net gain in area at each zone in the valve. Consequently, by re-apportioning the available port area and by employing my new features, a more efficient valve is provided.

While I have described my invention in connection with a specific embodiment thereof, it is to be clearly understood that this is done only by way of example, and not as a limitation to the scope of of my invention as set forth in the objects thereof and in the appended claims.

I claim:

1. A ported-plate, fluid-control valve, comprising:

a ported valve seat;

a stop plate;

means coupling said seat and plate together, in parallel, and spaced apart; and a plate-type valving element interpositioned between said seat and plate; wherein said seat, plate and element comprise (a) first means defining a first fluid inlet zone, a second fluid outlet zone, and a plurality of discrete, fluid-conducting zones intermediate said first and second zones, and (b) second means for effecting a substantially smooth flow of fluid through said zones; wherein said seat has (a) inner and outer, parallel surfaces, and (b) ports formed therein with port-entry apertures formed in said outer surface;

said ports are set apart by intervening ligaments;

said ligaments have greater and lesser widths defining said ligaments of tapered cross-sections;

said greater widths are more proximate to said outer surface; and said lesser widths are more proximate to said inner surface.

2. A valve, according to claim 1, wherein:
said second means comprises conjoined, radiused edges lining said apertures.
3. A valve, according to claim 1, wherein:
said seat has an outer perimeter;
said seat further has a plurality of ports formed therein, some of which, relative to said perimeter, are outermost seat ports, and some of which are inboard seat ports; and
said outermost seat ports are substantially as proximate to said perimeter as they are to any of said inboard seat ports which are closest thereto.
4. A valve, according to claim 1, further including:
a guide ring;
said ring having a base;
said base having a plurality of arms extending therefrom radially; wherein
said element has a central bore; and
said bore is slidably and pilotingly engaged with radially outermost ends of said arms.
5. A valve, according to claim 1, wherein:
said element has a central bore; and further including
means, interpositioned between said seat and said stop plate, for guiding said element in movement thereof to and from said seat; wherein
said guiding means comprises a plurality of arms confined within said central bore; and
said bore is slidably and pilotingly engaged with surfaces of said arms.
6. A ported-plate, fluid-control valve, comprising:
a ported valve seat;
a stop plate;
means coupling said seat and plate together, in parallel, and spaced apart; and
a plate-type valving element interpositioned between said seat and plate; wherein
said seat, plate and element comprise (a) first means defining a first fluid inlet zone, a second fluid outlet zone, and a plurality of discrete, fluid-conducting zones intermediate said first and second zones, and (b) second means for effecting a substantially smooth flow of fluid through said zones; further including
a guide ring;
said ring having a base;
said base having reliefs formed therein; and
a buffer plate movably interpositioned between said seat and stop plate; wherein
said buffer plate has scallop cut-outs formed therein; and
said reliefs and cut-outs are in aligned registry to define fluid-flow paths therethrough.
7. A ported-plate, fluid-control valve, comprising:
a ported valve seat;
a stop plate;
means coupling said seat and plate together, in parallel, and spaced apart; and
a plate-type valving element interpositioned between said seat and plate; wherein
said seat, plate and element comprise (a) first means defining a first fluid inlet zone, a second fluid outlet zone, and a plurality of discrete, fluid-conducting zones intermediate said first and second zones, and (b) second means for effecting a substantially smooth flow of fluid through said zones; further including
a guide ring interpositioned between said seat and said stop plate; and
a buffer plate movably interpositioned between said seat and said stop plate; wherein
said buffer plate has a plurality of limbs extending therefrom radially; and
said limbs are slidably and pilotingly engaged with said guide ring.

* * * * *